US009380815B2

(12) United States Patent
Toro-Gerstein

(10) Patent No.: US 9,380,815 B2
(45) Date of Patent: Jul. 5, 2016

(54) PRIVACY COVER

(76) Inventor: Maria Carolina Toro-Gerstein, Los Angeles, CA (US)

( * ) Notice: Subject to any disclaimer, the term of this patent is extended or adjusted under 35 U.S.C. 154(b) by 826 days.

(21) Appl. No.: 13/541,620

(22) Filed: Jul. 3, 2012

(65) Prior Publication Data

US 2014/0007315 A1 Jan. 9, 2014

(51) Int. Cl.
*A41D 1/20* (2006.01)

(52) U.S. Cl.
CPC ..... *A41D 1/205* (2013.01)

(58) Field of Classification Search
CPC ... A41D 2300/20; A41D 1/205; A41B 13/10; A61J 2009/0607; A61J 2009/0638; A61J 2009/0676
USPC ..... 2/104, 147, 274, 311, 88, 48, 49.1, 114, 2/247
See application file for complete search history.

(56) References Cited

U.S. PATENT DOCUMENTS

| | | | | |
|---|---|---|---|---|
| 88,752 | A | 6/1869 | Straus | |
| 496,313 | A | 4/1893 | Janowitz | |
| 514,720 | A | 2/1894 | McGowan | |
| 559,683 | A | 5/1896 | Crotty | |
| 905,420 | A | 12/1908 | Hagen | |
| 1,276,700 | A | 8/1918 | Kleemann | |
| 2,319,292 | A | 5/1943 | Boggs | |
| 2,520,026 | A * | 8/1950 | Beitchman | 2/227 |
| 2,682,055 | A | 6/1954 | LaDoux | |
| 2,736,900 | A * | 3/1956 | Koren | 2/114 |
| 2,804,626 | A | 9/1957 | Rossiter | |
| 2,809,375 | A | 10/1957 | Doron et al. | |
| 2,832,075 | A | 4/1958 | Davidson | |
| 2,914,771 | A | 12/1959 | Stavin et al. | |
| 3,016,544 | A | 1/1962 | Pinkney | |
| 3,599,643 | A | 8/1971 | Schwartz | |
| 3,799,175 | A | 3/1974 | Rowell | |
| 4,271,580 | A | 6/1981 | King et al. | |
| D275,827 | S | 10/1984 | Henry | |
| D277,352 | S | 1/1985 | Klein | |
| 4,528,699 | A | 7/1985 | Hughes | |
| 4,566,136 | A | 1/1986 | Echols | |
| 4,660,227 | A | 4/1987 | Abramson | |
| 4,712,251 | A | 12/1987 | Cobble | |
| 4,716,597 | A | 1/1988 | Griggs | |
| 4,797,953 | A | 1/1989 | Dameron | |
| 4,903,349 | A | 2/1990 | Arai | |

(Continued)

FOREIGN PATENT DOCUMENTS

| | | | |
|---|---|---|---|
| CA | 2169588 | C | 10/1998 |
| CA | 2424035 | C | 2/2010 |

(Continued)

OTHER PUBLICATIONS

PCT, International Search Report and Written Opinion, Oct. 4, 2013, International Application No. PCT/US2013/048346, 11 pages.

*Primary Examiner* — Robert J Hicks
*Assistant Examiner* — Timothy K Trieu
(74) *Attorney, Agent, or Firm* — Maceiko IP

(57) ABSTRACT

An improved privacy cover is described which may be used for breastfeeding a baby or to provide privacy. The cover includes one contiguous sheet, or two panels joined together, having a cutout for the wearer's head. Where two panels are used they may be sewn at their top edges. The cover includes a member to provide a viewing area, and neck facing to provide support to the member.

23 Claims, 13 Drawing Sheets

(56) References Cited

U.S. PATENT DOCUMENTS

| | | | | |
|---|---|---|---|---|
| 4,924,528 | A | 5/1990 | Trombetti-Dickens | |
| 4,964,172 | A | 10/1990 | Bollard | |
| 4,989,268 | A | 2/1991 | Stolhand | |
| 4,995,116 | A | 2/1991 | Beauchamp | |
| 5,034,999 | A | 7/1991 | Lubbers | |
| 5,090,059 | A | 2/1992 | Kahl | |
| 5,182,813 | A | 2/1993 | Booze | |
| 5,259,068 | A | 11/1993 | Carroll | |
| D343,498 | S | 1/1994 | Donahue | |
| 5,321,863 | A | 6/1994 | Yamaguchi et al. | |
| 5,469,582 | A | 11/1995 | Livingston | |
| 5,479,662 | A | 1/1996 | Runco | |
| 5,544,364 | A | 8/1996 | Weber | |
| 5,570,474 | A | 11/1996 | Berry et al. | |
| 5,652,958 | A | 8/1997 | Farrell-Mestas | |
| 5,665,057 | A | 9/1997 | Murphy | |
| 5,727,489 | A | 3/1998 | Braverman | |
| 5,848,439 | A | 12/1998 | Huseth et al. | |
| 5,893,171 | A | 4/1999 | Ries | |
| D408,966 | S | 5/1999 | Lawrence | |
| D410,382 | S | 6/1999 | Therriault | |
| 5,934,970 | A | 8/1999 | Morgan et al. | |
| 5,956,762 | A | 9/1999 | Adams | |
| 6,021,521 | A | 2/2000 | Baratta | |
| 6,156,410 | A | 12/2000 | Bassler | |
| 6,216,273 | B1 | 4/2001 | Williams | |
| 6,216,274 | B1 | 4/2001 | Harris | |
| 6,327,712 | B1 | 12/2001 | Armstrong | |
| D456,661 | S | 5/2002 | Henegan | |
| 6,389,597 | B1 | 5/2002 | Henegan | |
| 6,581,209 | B2 | 6/2003 | Bramhan | |
| 6,594,829 | B1 | 7/2003 | Turkheimer | |
| 6,836,900 | B1 | 1/2005 | Fus | |
| 6,986,163 | B2 | 1/2006 | Dugan | |
| 7,065,810 | B2 | 6/2006 | Robinson | |
| 7,114,191 | B1 | 10/2006 | Butler-Penenberg | |
| 7,178,185 | B1 | 2/2007 | Nattler | |
| 7,406,718 | B2 | 8/2008 | Ekelund et al. | |
| 7,409,727 | B2 | 8/2008 | Ekelund et al. | |
| 7,469,424 | B2 | 12/2008 | Good et al. | |
| 7,540,036 | B1 | 6/2009 | Paulsen | |
| 7,566,328 | B2 | 7/2009 | Hooper | |
| 7,765,613 | B2 | 8/2010 | Carr | |
| 7,784,108 | B2 | 8/2010 | Ekelund et al. | |
| 7,805,770 | B2 | 10/2010 | Ekelund et al. | |
| 7,805,771 | B2 | 10/2010 | Ekelund et al. | |
| 8,091,145 | B2 | 1/2012 | Ekelund et al. | |
| 8,151,372 | B2 * | 4/2012 | Densmore et al. | 2/104 |
| 8,191,173 | B2 | 6/2012 | Ekelund et al. | |
| 8,196,222 | B2 | 6/2012 | Ekelund et al. | |
| 2002/0108162 | A1 | 8/2002 | Bolds-Leftridge | |
| 2002/0152535 | A1 * | 10/2002 | Gaza | 2/114 |
| 2003/0079267 | A1 | 5/2003 | Dugan | |
| 2003/0135908 | A1 | 7/2003 | Turkheimer | |
| 2003/0135909 | A1 | 7/2003 | LaTorre | |
| 2003/0196240 | A1 | 10/2003 | Meacham et al. | |
| 2005/0015881 | A1 | 1/2005 | Littlehorn | |
| 2005/0204501 | A1 | 9/2005 | Golec | |
| 2006/0010569 | A1 | 1/2006 | Tawfik | |
| 2006/0059597 | A1 | 3/2006 | LaRocco | |
| 2007/0049147 | A1 | 3/2007 | Hill et al. | |
| 2007/0094764 | A1 | 5/2007 | Wakefield et al. | |
| 2007/0124845 | A1 | 6/2007 | McCoy | |
| 2008/0005824 | A1 | 1/2008 | Seckinger | |
| 2009/0000005 | A1 | 1/2009 | Amson | |
| 2010/0088800 | A1 | 4/2010 | Pate-Gurule | |
| 2010/0281598 | A1 | 11/2010 | Densmore et al. | |
| 2011/0296581 | A1 | 12/2011 | Armstrong | |
| 2012/0151657 | A1 * | 6/2012 | Gibbons et al. | 2/104 |

FOREIGN PATENT DOCUMENTS

| | | | |
|---|---|---|---|
| EP | 1 105 008 | B1 | 9/2005 |
| GB | 2 413 852 | A | 11/2005 |
| GB | 2 443 601 | A | 5/2008 |
| GB | 2 481 193 | A | 12/2011 |
| JP | H09-157915 | | 6/1997 |
| JP | 2001-200410 | | 7/2001 |
| JP | 2002-266117 | | 9/2002 |
| JP | 2008-031613 | | 2/2008 |
| JP | 2008-214776 | | 9/2008 |
| JP | 2009-091667 | | 4/2009 |
| JP | 2010-159525 | | 7/2010 |
| JP | 2010-242267 | | 10/2010 |
| WO | WO2011-019991 | A3 | 5/2011 |

* cited by examiner

PRIVACY COVER

FIELD OF THE INVENTION

The current invention relates to improved privacy covers, including covers that may be worn by breastfeeding or bottle-feeding mothers, and covers that may be worn to generally protect a baby and/or provide privacy.

BACKGROUND OF THE INVENTION

Different types of nursing covers currently exist which cover a baby and a mother's chest while nursing. However, there are several problems with existing nursing covers including the following:

First, certain existing nursing covers typically involve straps, rings or other cumbersome attachment means in order for the mother to wear the cover and keep it in place. For example, several existing nursing covers require the mother to tie straps behind the mother's neck and/or waist. Other existing nursing covers require a strap to be threaded through a ring. These cumbersome attachment means may be difficult to manipulate or may require too much time when a mother is hurrying to feed a hungry baby. Furthermore, these straps and other attachment means may come undone potentially leading to the nursing cover falling off of the mother while the baby is feeding. Other existing nursing covers include a neck band or other means to secure the cover to the mother. However, these covers may be uncomfortable for a mother to wear, especially when considering that a baby may feed for significant lengths of time.

Second, certain existing nursing covers do not provide adequate coverage of the private area and/or for the baby who is feeding. This is because these types of covers focus on covering only the front of the mother which may allow others to see the private area through the sides. When a mother is feeding in a public place, this lack of coverage may be discomforting to the mother and/or baby.

Third, certain existing nursing covers do not provide a viewing area for the mother to watch the baby, and for the baby to see the mother, while feeding. This is a drawback because visual contact is preferable to aid in bonding between mother and baby, and also allows the mother to generally see how the baby is doing during feeding, e.g., allows the mother to guide the baby to latch on, etc.

Fourth, certain existing covers have drawbacks relating to their appearance. For example, certain covers use loud prints or other patterns in their design which may appear gaudy and may not be soothing to the baby. Furthermore, certain covers involving straps may generally resemble a cooking apron. Still further, other existing covers are generally not fashionable and may cause the potential wearer not to wear the cover.

SUMMARY OF THE INVENTION

The current invention addresses the foregoing problems and provides a unique, easy to use privacy cover for nursing or general protection.

In a first aspect of the invention, a privacy cover is described for use with a breastfeeding or bottle-feeding mother. In this aspect of the invention, the cover generally drapes over the woman's shoulders to provide both front and back coverage, as well as side coverage which in turn provides increased overall coverage and privacy.

Another aspect of the invention involves ease of use. The manner in which the cover drapes over a mother avoids the need for straps, rings or other attachment means that may be difficult to manipulate. The current invention also avoids the need for neck bands or other means to hold the cover in place that may make the cover uncomfortable to wear.

In another aspect of the current invention, the cover provides a viewing area so that mother and baby may see each other during feeding, thereby enhancing the bonding experience. The viewing area may be facilitated by a flexible, semi-rigid or rigid member or adjustable member. The viewing area may also be facilitated by the support provided by the cover as draped over the wearer's shoulders as well as the neck facing that may be incorporated into or near a cutout through which the wearer's head may pass.

In another aspect of the invention, the cover may be configured to be comfortable to wear and stylish in appearance. In this aspect, the cover may also reflect colors or designs that are soothing to the baby.

In another aspect of the invention, the cover may be used for other purposes, such as a blanket, stroller canopy or other purpose.

DETAILED DESCRIPTION OF THE PREFERRED EMBODIMENTS

Figure 1:
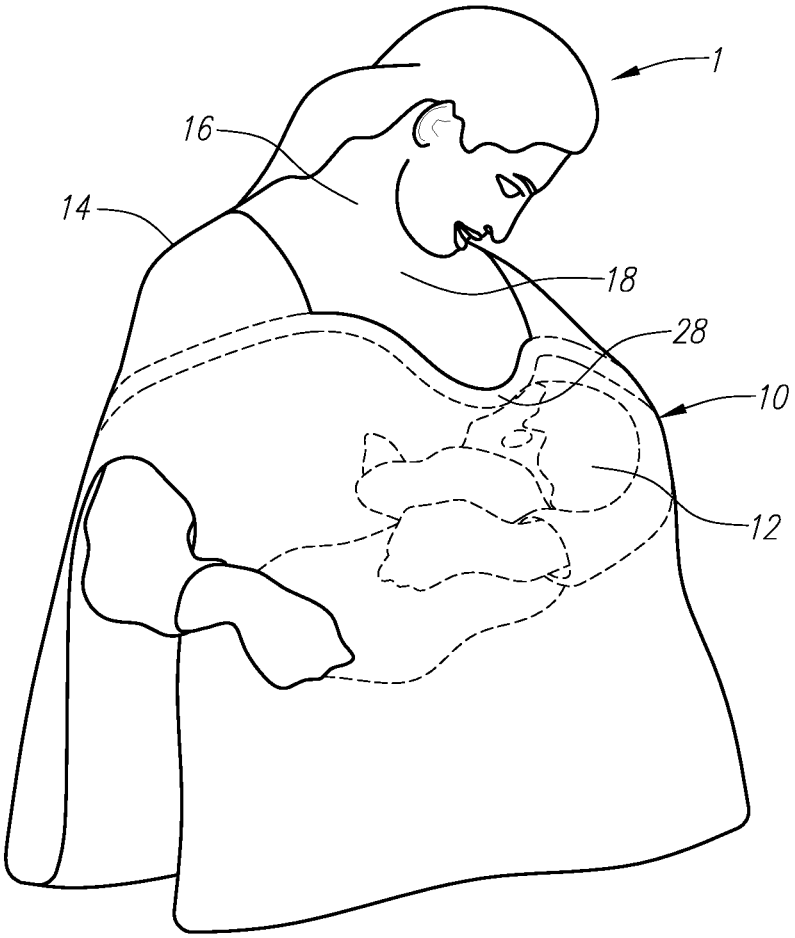
FIG. 1 shows a cover worn by a mother breastfeeding a baby.

The improved privacy cover is now described with reference to the figures. The same reference numerals are used for the same or similar components in more than one figure. It should be noted that while the following description generally refers to a mother wearing the cover, the cover may be worn by others who are not the baby's mother. For example, a woman who is not the mother, or a man, may bottle feed the baby and still wear the cover for privacy or for the general protection of the baby. The cover may also be worn to help the baby sleep, such as may occur after feeding. The cover may also be used for other purposes such as a stroller cover and blanket. Accordingly, the cover of the current invention is not limited for use by a breastfeeding mother, but instead includes all types of users or wearers, and uses of the cover.

Referring to FIG. 1, a woman 1 is shown wearing a privacy or nursing cover 10 according to one embodiment of the current invention. As shown, cover 10 may include a front portion 12 and a back portion 14. Preferably, cover 10 may be configured so that front and back portions 12, 14 are joined together so that they fit over the mother with a cutout 16 for the mother's head. In this configuration, cover 10 may generally resemble a poncho, thereby providing increased coverage by covering the mother's front and back. Cover 10 also preferably includes a viewing area 18 that may be formed by a member 28 that may be adjustable. Viewing area 18 allows the mother to view the feeding baby and also allows the baby to see the mother to promote bonding.

As shown in FIG. 1, cover 10 also provides coverage of the mother's sides because front and back portions 12, 14, when joined, may generally drape over the mother so as to cover her sides. This is in sharp contrast to existing front-only covers that resemble an apron or that only include a front sheet. To facilitate side coverage, snaps or other attachment means may be included to more securely join front and back portions 12, 14 as discussed later.

Figure 2:
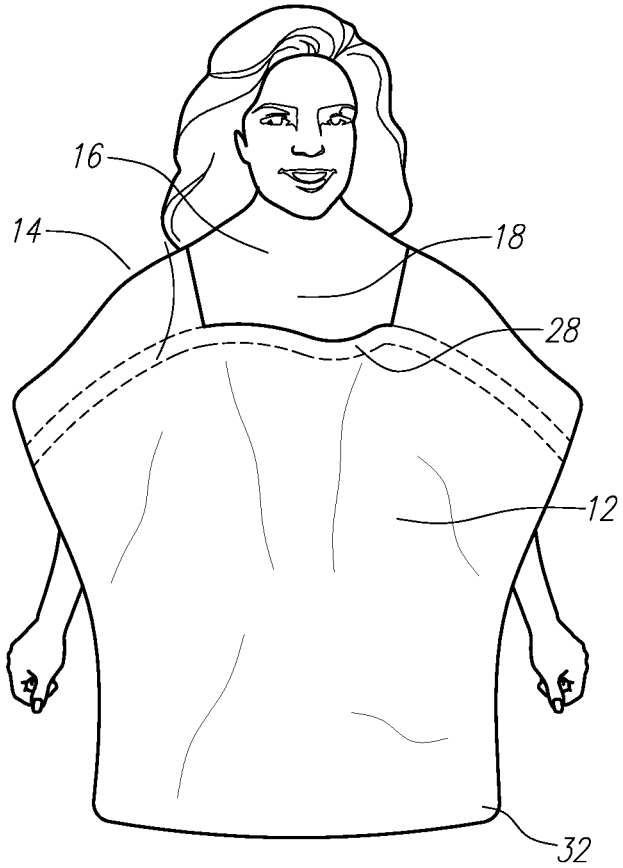
FIG. 2 shows a cover with a viewing area relatively closed and a curved front.
Figure 3A:
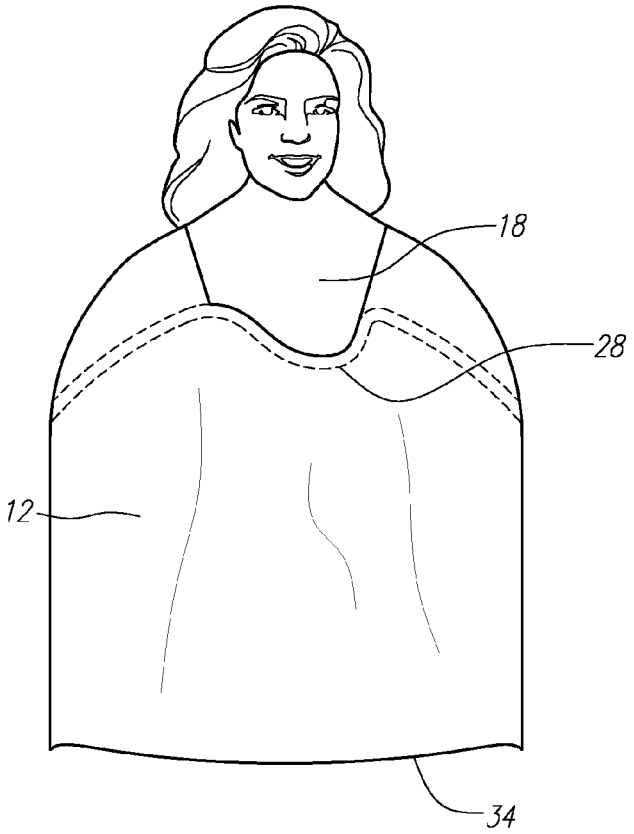
FIG. 3A shows a front view of a cover being worn with a viewing area relatively opened and a straight-edged sides.
Figure 3B:
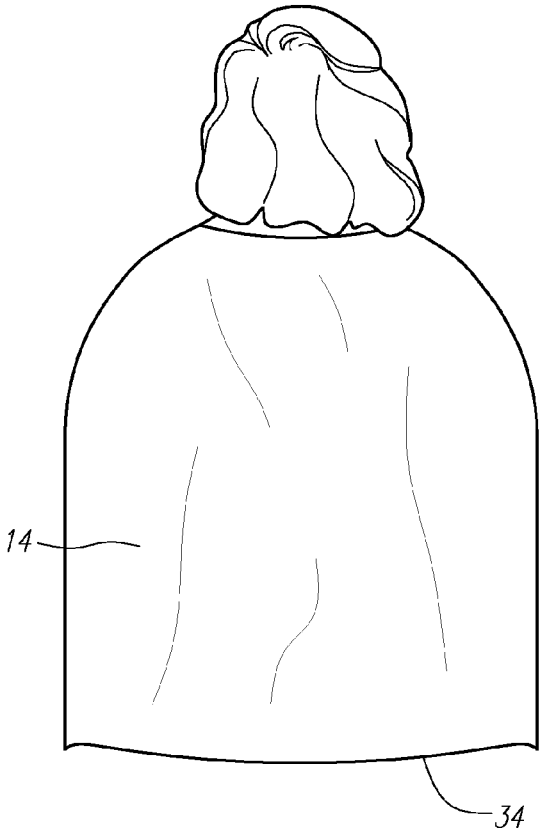
FIG. 3B shows a rear view of the cover of FIG. 3A being worn.

Cover 10 may be formed in various configurations. For example, FIG. 2 shows cover 10 with curved sides 32. Alternatively, and as shown in FIG. 3A and 3B, cover 10 may include straight edges 34 (that may curve when cover 10 is draped over the wearer). Other designs and styles may be used and the current invention is not limited to those shown in the figures. Accordingly, a benefit of cover 10 is that it may be configured according to the desired style of the wearer. It is also preferred that certain embodiments of cover 10 reflect a subdued pattern or color that is soothing to the baby.

Figure 4:
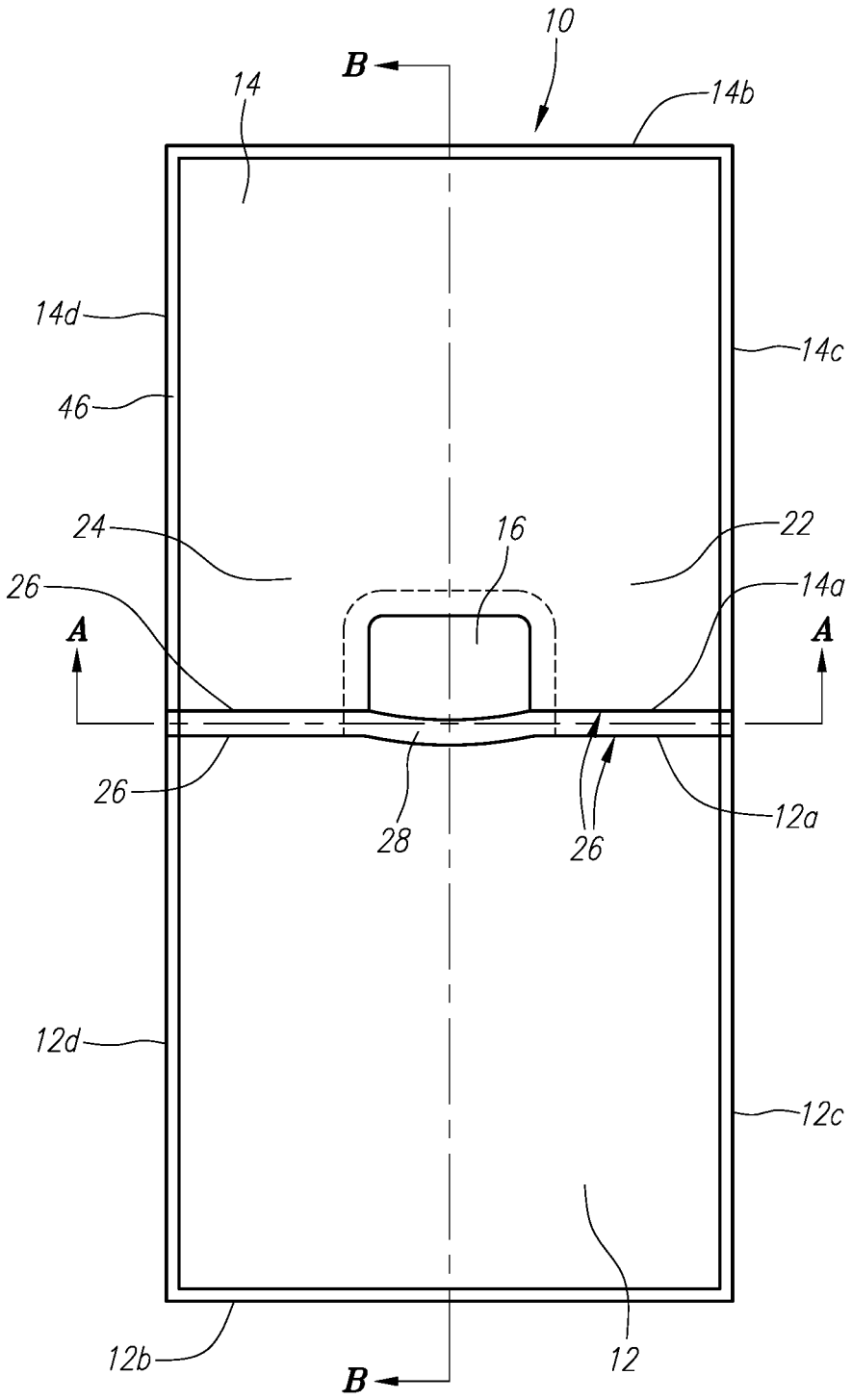
FIG. 4 is a top (exterior) plan view of an embodiment of a cover having two panels joined together.

An embodiment of cover 10 is now described with reference to FIGS. 4-7. FIG. 4 is a top (exterior) plan view of cover 10 laid flat. As shown, cover 10 may include two panels, i.e., front panel 12 and back panel 14 that may generally correspond to front and back portions 12, 14 described above. Front panel 12 may cover the front of a nursing or bottle-feeding mother, or other wearer. Back panel 14 may cover the back of a nursing or bottle-feeding mother, or other wearer. Back panel 14 may also include left wing 22 and right wing 24 that may extend over the wearer's shoulders.

Front panel 12 may include top edge 12*a*, bottom edge 12*b*, left edge 12*c* and right edge 12*d*. Back panel may include top edge 14*a*, bottom edge 14*b*, left edge 14*c* and right edge 14*d*. It is preferred that the material comprising panels 12, 14 is folded over along at least one of its edges, with the folded-over edge being sewn to the respective panel 12 or 14. In this manner, it is preferred that edges 12*b*-*d* and 14*b*-*d* are preferably not actual edges of the material that may fray or otherwise deteriorate. As discussed later, edge 12*a* may also be folded over as may be edge 14*a*. It is preferred that the folded-over sections extend about the periphery of panels 12, 14 and may also provide some cushioning to the wearer. As discussed above, certain of these edges may be straight while certain edges may be curved depending on the design and style chosen for cover 10.

In this embodiment, front and back panels 12, 14 may comprise two separate panels that are sewn or otherwise attached together at seams 26 as discussed in more detail later. Generally, top edge 12*a* may be joined to back panel 14, and top edge 14*a* may be joined to front panel 12 at seams 26. Panels 12, 14 may be joined by sewing or any other suitable method. Alternatively, and as discussed below, cover 10 may comprise a single continuous panel that does not include top edges 12*a*, 14*a*.

Panels 12, 14 may be made of cotton, fleece, hemp-based silk, bamboo or other breathable natural fiber fabrics, polyester, cotton with spandex, cotton and elastomers, rayon, knitted fabrics, woven fabrics or any other suitable material. Preferably, the material comprising cover 10 is comfortable for the mother to wear, and is sensitive to the baby's skin to avoid rash. It is also preferred that the material comprising cover 10 breathes to provide ventilation. Cover 10 may also include slits (not shown) thereby forming vents to provide ventilation.

Embodiments of cover 10 may be designed to withstand certain environments. For example, cover 10 may comprise a material that is water-repellent and/or waterproof. Also, cover 10 may be designed for outdoor or cooler environments by including a fleece or other liner to provide warmth. The liner may be removable if extra warmth is not necessary.

Figure 5:
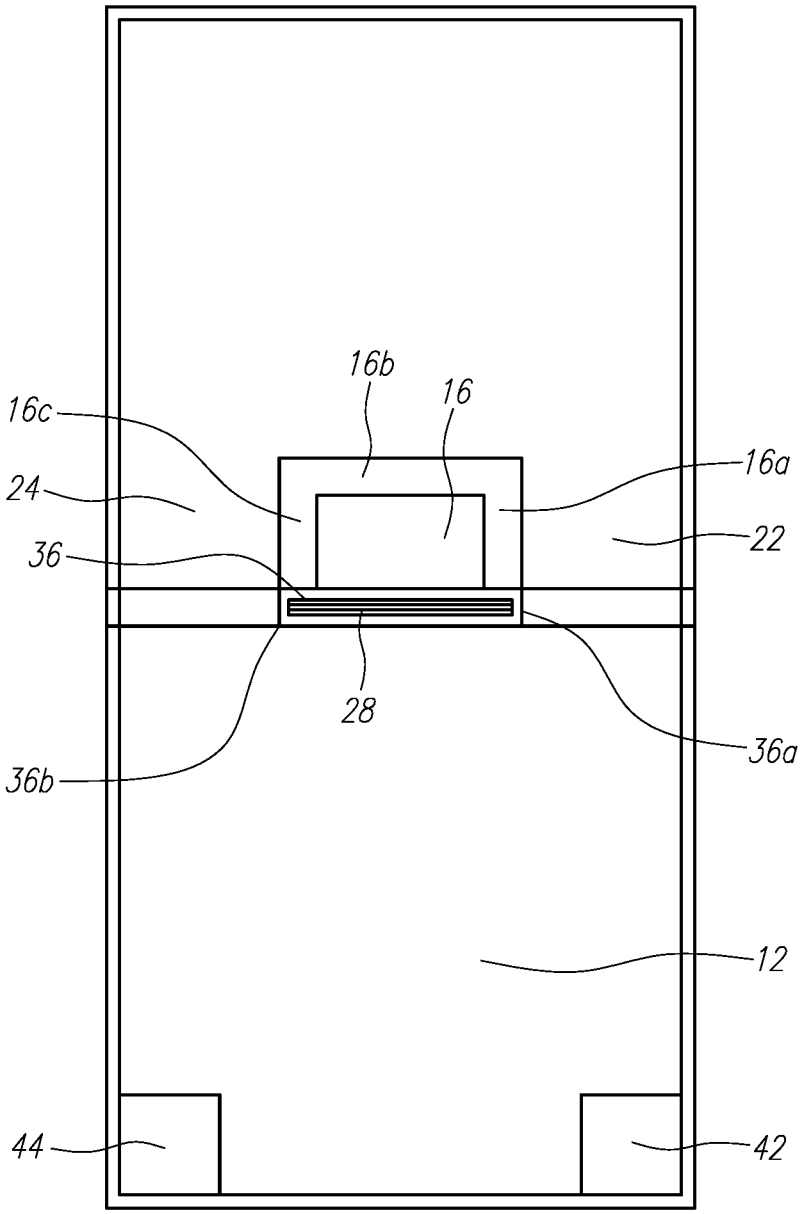
FIG. 5 is a bottom (interior) plan view of the embodiment of FIG. 4.
Figure 6A:
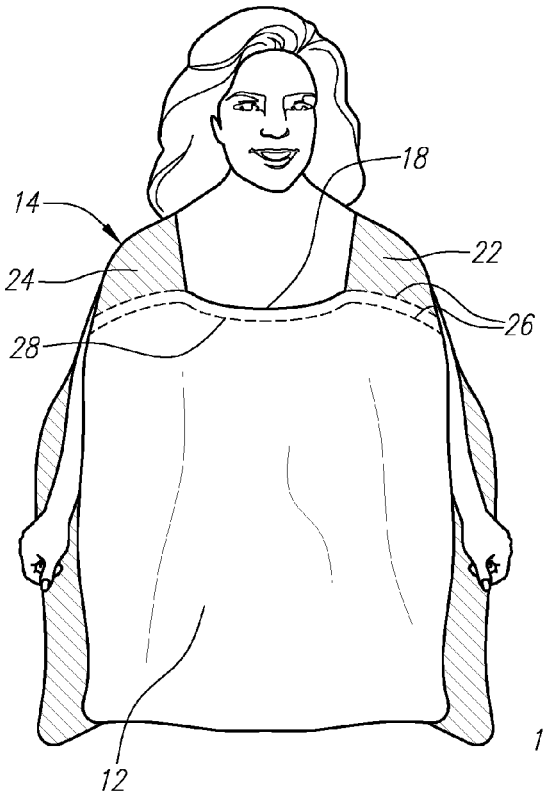
FIG. 6A shows the cover of FIG. 4 having straight-edged sides.
Figure 6B:
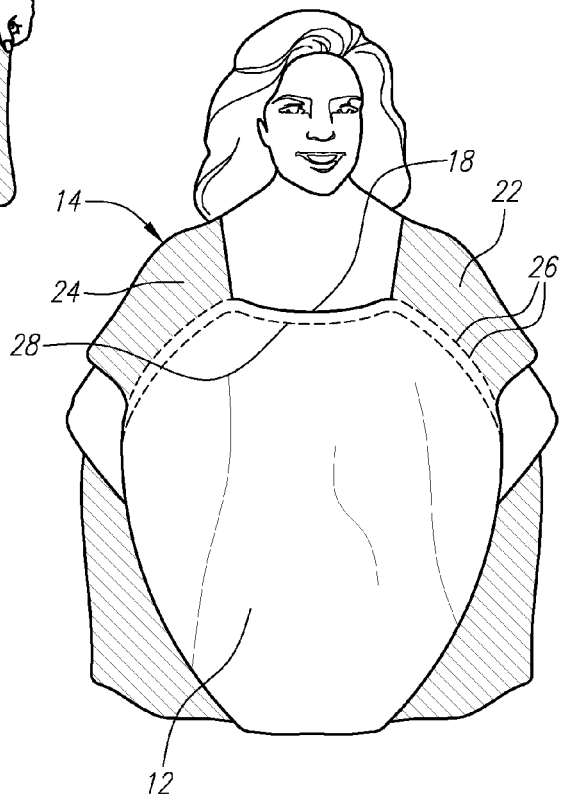
FIG. 6B shows the cover of FIG. 4 having curved side edges.

In the embodiment of FIGS. 4, 5, 6A and 7, front panel 12 may generally comprise a square or rectangular shape, though other shapes may be used, e.g., its edges may be curved as shown in FIG. 6B. Rear panel 14 may also generally comprise a square or rectangular shape with cutout 16 at or near its top, thereby forming left and right wings 22, 24. As shown in FIG. 5, cutout 16 may be formed so as to include edges 16*a*, 16*b*, 16*c*. As discussed in more detail later, edges 16*a*-*c* may also include additional sheet(s) of material to form a neck border or neck facing which may provide support for member 28 as well as overall support for cover 10 as it is worn. Neck border or facing 16*a*-*c* may comprise one piece with an oval, rectangular or other shape, or three different pieces sewn to form an oval, rectangular or other shape. The material comprising cover 10 is preferably folded over and sewn so that edges 16*a*-*c* avoid fraying and provide cushioning to the wearer.

The top edge of back panel 14, i.e., the top edges of wings 22, 24 may be connected to front panel 12 at seams 26 by sewing or any other suitable manner. Configured in this manner, cover 10 may be fitted over the wearer and drape over the wearer's shoulders.

In this embodiment, front panel 12 preferably includes an adjustable member 28 which may be located at or near top edge 12*a*. In a preferred embodiment, and referring to FIG. 5, adjustable member 28 may reside in a pocket 36. Member 28 may permanently reside in pocket 36. Alternatively, member 36 may be removable therefrom.

Pocket 36 may be formed by folding over what would originally be considered the top edge of front panel 12, i.e., the actual edge of the material comprising front panel 12, and sewing it to front panel 12. After this folding, top edge 12*a* is preferably not the actual edge of the material, but is instead a folded-over edge. The sewing of the folded-over edge of front panel 12 to form pocket 36 may occur as top edge 12*a* is attached to wings 22, 24 of back panel 14. In this manner, a pocket is formed in the space created between the folded-over portion of panel 12. Adjustable member 28 may be placed on panel 12 before top edge 12*a* is folded over. In this manner, when top edge 12*a* is folded over, it encloses member 28. Alternatively, pocket 36 may first be formed by folding the original edge of front panel 12, and then member 28 may be placed therein so that member 28 is located generally in the middle of panel 12. When in place, additional sewing may occur on pocket 36 at or near the ends of member 28. This additional sewing is shown at locations 36*a*, 36*b* in FIG. 5. With pocket ends 36*a*, 36*b* so formed, member 28 is generally held in place so as to provide a viewing area as discussed below.

Figure 12A:
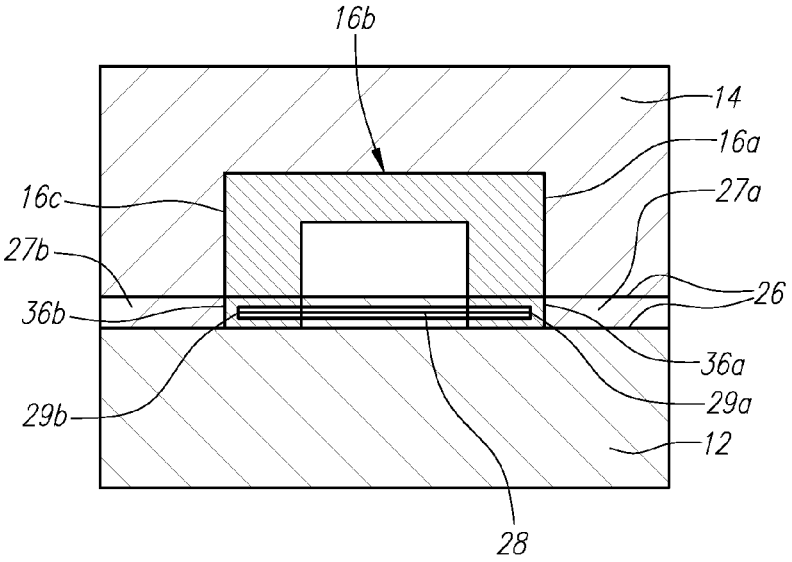
FIG. 12A is a top plan view of the cover of FIG. 4 in more detail.

The forming of pocket 36 and placement of member 28 therein, the joining of panels 12, 14 and the forming of neck facing 16*a-c* are now described in more detail with reference to FIGS. 12A-C. FIG. 12A is a top plan view where different hatching lines are used to show various components of the current invention. More specifically, diagonal lines (upper left to lower right) depict front panel 12, vertical lines depict back panel 14 and diagonal lines (upper right to lower left) depict neck facing 16*a-c*.

As shown in FIG. 12A, there are preferably regions 27*a*, 27*b* of overlap between front and back panels 12, 14. There are also preferably regions 29*a*, 29*b* of overlap between front panel 12 and back panel 14, as well as facing 16. From front to back, overlap regions 27, 29 may both generally exist between seams 26. From side to side, overlap regions 27*a*, 27*b* may exist between the outer edges of cover 10 and the region where facing 16 is attached. From side to side, overlap regions 29*a*, 29*b* may exist where facing 16 also overlaps with panels 12, 14, i.e., in part of the facing region. This is shown in FIG. 12A by there being two different types of hatching lines in regions 27*a*, 27*b* and three different types of hatching lines in regions 29*a*, 29*b*.

Member 28 may be located in pocket 36 as follows. Initially, member 28 may be pre-covered or otherwise enclosed with fabric or other material to avoid any sharp edges on member 28 potentially cutting the wearer or baby. Member 28, pre-covered or not pre-covered, may then be placed on front panel 12 a relatively short distance from its original top edge. The original top edge of panel 12 may then be folded over member 28 and back onto panel 12 thereby forming pocket 36. In one embodiment, the folded-over top edge may then be sewn to front panel 12. The folded-over section may be about ¾" but other dimensions may be used. Alternatively, the folded-over section may be created first and member 28 placed therein.

The folded-over section of panel 12 on either side of cutout 16 may generally correspond to overlap regions 27, 29 in FIG. 12A as well as the folded-over length along cutout 16. The placement of member 28 is readily shown in the side section view of FIG. 12C which shows two layers of panel 12 surrounding member 28.

The top area of back panel 14 may then be placed over the folded-over region of front panel 12. Front and back panels 12, 14 may then be sewn together along seams 26. That is, top edge 12*a* may be sewn to back panel 14, and top edge 14*a* may be sewn to front panel 12. When so assembled, regions 27*a*, 27*b* may be formed by the overlap of panels 12, 14, so that there are three layers of material, i.e., two layers of front panel 12 due to its being folded over and a layer from rear panel 14. Additionally, seams 36*a,b* at either end of pocket 36 may be sewn at this time thereby enclosing the ends of member 28 and further forming pocket 36. The original top edge of back 14*a* may also be folded over similar to front panel 12 thereby adding another layer to overlap regions 27*a,b*.

Neck border or neck facing 16*a-c* is now further described. Neck border or facing 16*a-c* may comprise an additional piece or pieces of material that may generally be placed around the periphery of cutout 16. As noted above, neck facing 16*a-c* may assume different shapes and may comprise one or more pieces. However the neck facing is configured, piece(s) 16*a-c* may be placed on back panel 14 along the periphery of cutout 16.

Figure 12C:
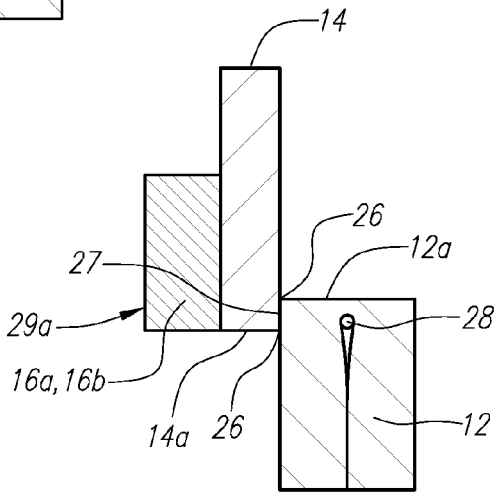
FIG. 12C is a side section view taken along section line B-B of FIG. 4.
Figure 12B:
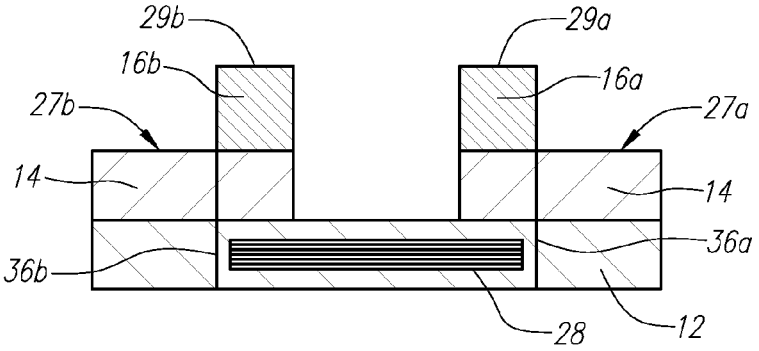
FIG. 12B is a front section view taken along section line A-A of FIG. 4.

As shown in FIGS. 12A and 12C, the ends of neck facing 16*a*, 16*c* extend over the overlap region between front and back panels 12, 14 thereby forming overlap regions 29*a,b*. Overlap regions 29 may thus comprise four layers of material, i.e., two layers from front panel 12 due to its being folded over, a layer from back panel 14 and a layer from facing 16*a*, 16*c*. If the original top edge of back panel 14 is folded over, another layer of material may exist in overlap regions 29*a,b*.

It is preferred that the neck facing 16*a*, 16*c* be wide enough so that they extend over and along the length of pocket 36 for some distance so as to provide support for member 28. That is, as shown in FIG. 12A, it is preferred that the dimension of neck facing 16*a*, 16*c* along seams 26, i.e., the width of facing 16*a*, 16*c*, extends sufficiently along seams 26 so as to provide support for member 28. In a preferred embodiment, facing 16*a*, 16*c* extend along pocket 36 for one inch. However, other dimensions may be used.

Facing 16*a*, 16*c* may support member 28 by generally providing a lateral constraint on member 28 so that member 28 does not simply fall down on the wearer's chest. This lateral constraint may be provided, for example, by virtue of the increased thickness of overall material that exists at the ends of pocket 36 as best shown in front and side section view 12B and 12C, respectively, which may correspond to overlap regions 29*a,b*. In other words, at these locations, the thickness of front panel 12 (two layers), rear panel 14 and facing 16*a*, 16*c* are combined. This combined thickness preferably supports member 28 by providing a lateral constraint to prevent or hinder member 28 from falling down. That is, this lateral constraint may generally provide a lateral force up and over the wearer's shoulders that counteracts the force of gravity on member 28. In this manner, member 28 may preferably avoid falling flat thereby preserving viewing area 18.

Neck facing 16*a*, 16*c* may also be sewn along seams 26. This may occur as front and back panels 12, 14 are sewn together along seams 26, or at another time in the manufacturing process. To this end, the sewing of the folded-over section of front panel 12, the sewing together of panels 12, 14 and the sewing together of facing 16*a*, 16*c* may occur at the same time or different times.

Member 28 and the viewing area 18 it may generally provide are now further described. Member 28 may comprise any number of materials or combinations thereof, and may be adjustable. For example, member 28 may comprise a pliable polymeric, such as plastic, or natural material. Member 28 may also comprise plastic or aluminum sections joined by a tension cord or lightweight metal ribbing.

Figure 7:
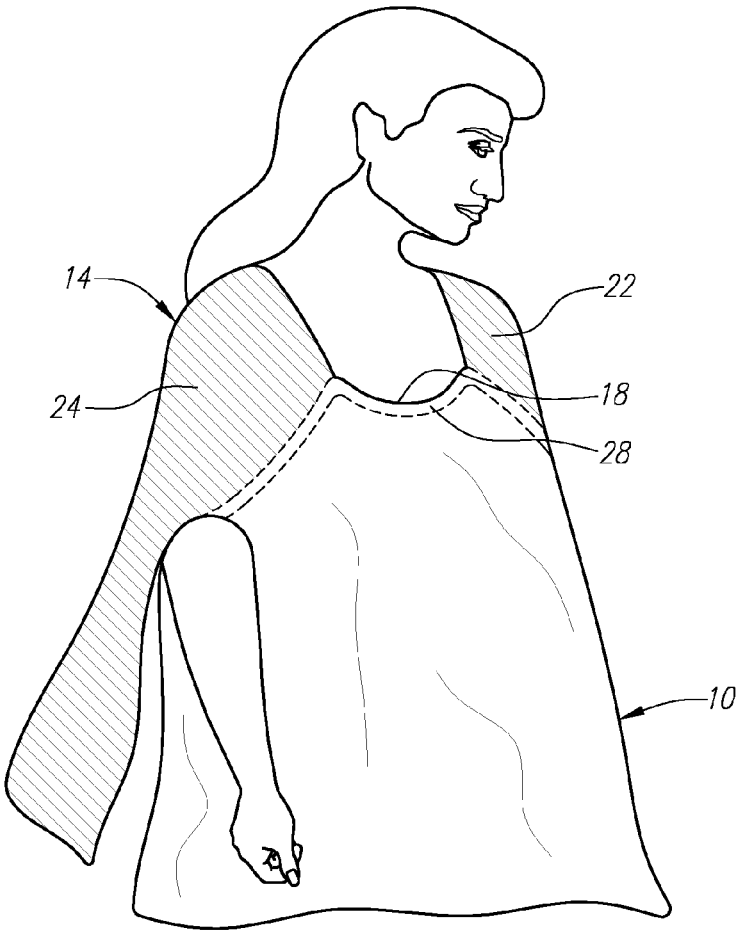
FIG. 7 shows the cover of FIG. 4 from the side as it is worn.

Member 28 may naturally have a curved shape to help provide viewing area 18. More specifically, and as shown in FIGS. 6A, 6B and 7, viewing area 18 may be formed by front panel 12 with the curved shape provided by member 28, along with support provided by wings 22, 24 as well as neck facing 16*a-c* and overlap regions 27, 29.

In this embodiment, the naturally curved member 28 is preferably capable of deforming in response to manual adjustments. This allows member 28 to be adjusted to be more or less curved to permit larger or smaller viewing areas 18, respectively, depending on the amount of privacy desired. Also, adjustable member 28 may be adjusted so as to be generally flat so as to provide little or no viewing area, such as where cover 10 may just be generally worn by the mother without a baby present, or to provide more privacy to the baby if present. In a preferred embodiment, this may occur by the wearer pressing against member 28 to flatten it out.

As noted above, member 28 may be covered with fabric before being inserted in pocket 36 so as to avoid any sharp edges contacting the wearer or baby. Other types of covers may be used for member 28. Alternatively, a cover may not be used. As discussed above, after member 28 is properly located within pocket 36, seams 36*a*, 36*b* may be sewn to hold member 28 generally in the center of panel 12.

In another embodiment, member 28 be sealed as noted above and later removed from pocket 36. To this end, front panel 12 may be un-stitched to remove member 28. Alternatively, front panel 12 may have a hole formed at one or both ends of pocket 36 to allow member 28 to be removed. As further alternatives, pocket 36 may include snaps, a zipper or some other means (not shown) to close pocket 36 and adjustable member 28 therein, but later opened to allow member 28 to be removed and/or replaced if need be.

In different embodiments, member 28 may be flexible, rigid or semi-rigid and/or formed in a curved shape. For example, member 28 may comprise an adjustable material such as plastic or pliable polymeric material that generally holds its curved shape. In certain embodiments, the shape of this type of member 28 may be adjusted by the wearer, but may later reassume a naturally curved shape.

As another alternative, member 28 may comprise wood, steel or other more rigid materials that have a curved shape and maintain that shape.

In yet another embodiment, member 28 may comprise a flexible, rigid or semi-rigid material that may be adjusted to a curved shape, and then later adjusted to a straightened shape. The material properties of this type of stiffener preferably provide that adjustable member 28 will hold this curved position and later hold its straightened position. Aluminum or other malleable materials may be used as member 28 for this purpose. With such materials, member 28 may be bent to a curved position to provide viewing area 18 for a feeding, and then later straightened so that the cover may be folded up for storage.

In this embodiment, it is preferred that the material comprising member 28 have sufficient strength and modulus of elasticity to withstand repeated reconfiguring between straight and curved positions. However, it is noted that member 28 need not be curved an excessive amount to provide a viewing area. Accordingly, it is believed that many types of aluminum and other rigid or semi-rigid materials are suitable for forming member 28. With this type of material, member 28 may not reassume any curved or straight configuration due to any natural tendencies. Instead, once the member 28 is manually adjusted to a certain configuration, it may generally stay in that configuration until the wearer exerts a force thereon. Alternatively, certain semi-rigid materials may exhibit a tendency to reassume a predisposed shape, e.g., curved.

In yet another embodiment, member 28 may comprise an adjustable member that may alternate between straight and curved (or non-straight) configurations by virtue of joint mechanisms. For example, adjustable member 28 may comprise a straight plastic member that includes a joint at or near its center. In this configuration, the joint may be adjusted to different positions so that the wearer may simply bend the member from straight to V-shaped and the joint may maintain the V-shape. The wearer may then straighten the V-shape to straight. In this embodiment, the joint preferably allows a wearer to reconfigure the member without too much force, but when reconfigured, the joint still provides enough resistance to maintain the desired shape. Alternatively, adjustable member may include several joints along its length so that member 28 may be reconfigured to more of a curved shape. The joint(s) may comprise a ratchet or other suitable arrangement.

In yet another embodiment, member 28 may comprise a structure that includes features similar to those found in a Hoberman sphere, such as shown at: http://en.wikipedia.org/wiki/Hoberman_sphere.

As noted above, back panel 14 may include a rectangular or other shaped cutout 16 in the top edge 14*a*, thereby forming left and right support wings 22, 24. Wings 22, 24 may extend over the left and right shoulders and connect on either side to front panel 12. Front panel 12 may be shorter than back panel 14. For example, because back panel 14 may include wings 22, 24, back panel 14 may comprise a longer overall length than front panel 12.

Generally, front and back panels 12, 14 are preferably long enough to provide enough coverage over the mother so as to generally form a poncho type garment. The lengths may be varied to fit differently sized women. Alternatively, the lengths may be long enough to be tucked into the mother's pants so as to provide more stability. As a further alternative, panels 12, 14 may be sized so as to extend down to or around the wearer's waste.

The top edge 12*a* of front panel 12 may follow a straight line as discussed above. However, front panel 12 may also include a cutout (not shown) similar to cutout 16 in back panel 14. In this embodiment, the cutout 16 of back panel 14 may be smaller. As another alternative, front panel 12 or back panel 14 may neither include a cutout. In this embodiment, to provide a hole to accommodate the wearers head, the seam 26 between panels 12, 14 may only be partially sewn so as to leave a slit for the wearer's head. In this manner, the wearer may separate panels 12, 14 near their middles to allow for her head to fit through.

Front panel 12 may include two pockets 42, 44 as shown in FIG. 5. Pockets 42, 44 may be located in the bottom left and right corners and may be used for storage, e.g., to hold a pacifier, bib or other item. Other locations and shapes of pockets 42, 44 may be used.

As noted above, back panel 14 is preferably longer than the wings 22, 24 formed from the cutout 16, so that back panel 14 may extend down a length of the woman's back, thereby providing stability for cover 10 overall. The length of back panel 14 also preferably helps cover the sides of the woman as well as shown in FIG. 7. As an alternative for side coverage, front and back panels 12, 14 may include snaps 46 or other attachment along side edges 12*c*, 12*d*, 14*c*, 14*d* means to join the front and back panels.

Wings 22, 24 may overlap the shoulders of the nursing or bottle-feeding mother, thereby providing additional support, along with neck facing 16*a-c*, to member 28 in order to maintain a consistency in opening to view the baby and to readily provide adjustment via lowering or raising the front or back panels 12, 14. As mentioned above, in certain embodiments, member 28 may comprise an adjustable polymeric, or other synthetic or natural material that may have a curved shape that can be deformed, but may return to its original curved shape after adjustment. However, semi-rigid or rigid materials may also be used as member 28.

Via support wings 22, 24, back panel 14 creates the neck cavity/opening 18 that may have a round, oval or square shape to support for the adjustable member 28 in front panel 12. The adjustable member 28 may be stitched into top edge 12*a* of panel 12 and enclosed in pocket 36. This adjustable member 28 may be attached to panel 12 or configured in panel 12 where it can also be removed from the rectangular pocket 36. The adjustable member 28 may have a pre-determined curved shape; however, this shape may be adjusted by manually flexing the adjustable material comprising member 28. To this end, where member 28 comprises plastic or similar material that is generally curved, it may still be flexible enough so that its curve may be adjusted by the wearer. For example, the woman may shift the front and back panels to the desired locations before nursing or a bottle feeding. This will put some amount of force on member 28 and preferably causes member 28 to flex to the desired position and curvature to allow a desired viewing area.

Alternatively, where a more rigid or semi-rigid adjustable member 28 is used, the mother may position front and back panels 12, 14 to the desired location, and then bend member 28 to the desired curvature to again provide an appropriate viewing area for the nursing mother or bottle-feeding mother. And where a rigid member 28 is used, the wearer may simply locate member 28 to the desired position and adjust cover 10 accordingly.

The support provided by the back panel left and right wings 22, 24, working in concert with the neck facing 16*a-c* and front panel top edge 12*a*, to adjustable member 28, enables easy adjustment of the viewing area 18 to allow visibility of the baby or compensate for difference in the size and position of the mother and/or baby.

In use, the wearer may readily slip cover 10 over his or her head, position front and back panels 12, 14 and then adjust member 28 to provide the desired viewing area 18 of the baby under cover 10. Alternatively, after slipping on cover 10, the wearer may position member 28 as desired and adjust cover 10 appropriately. This is in sharp contrast to other existing covers that require cumbersome straps or other attachment means that may be difficult to manipulate, especially when attending to a hungry baby.

Figure 8:
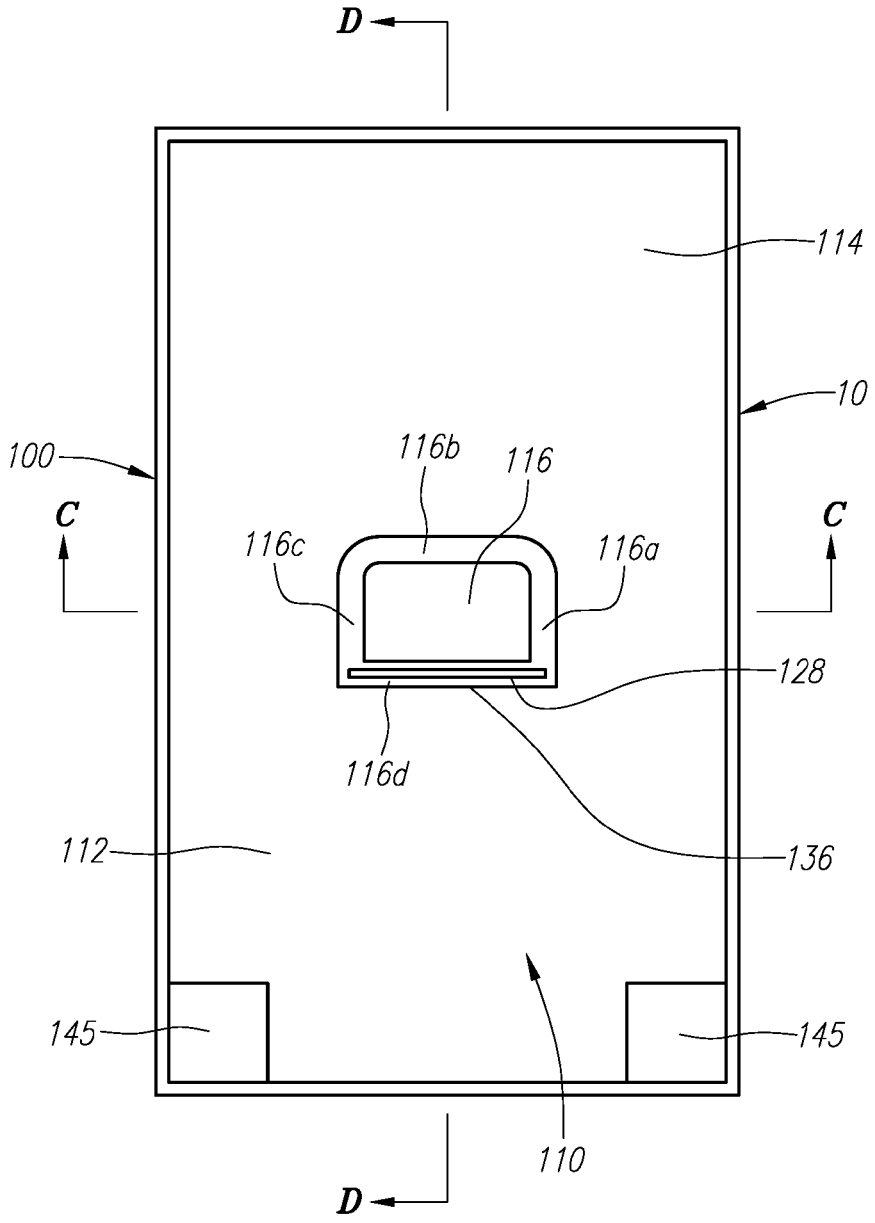
FIG. 8 is a bottom (interior) plan view of another embodiment of a cover comprising a continuous sheet.
Figure 9:
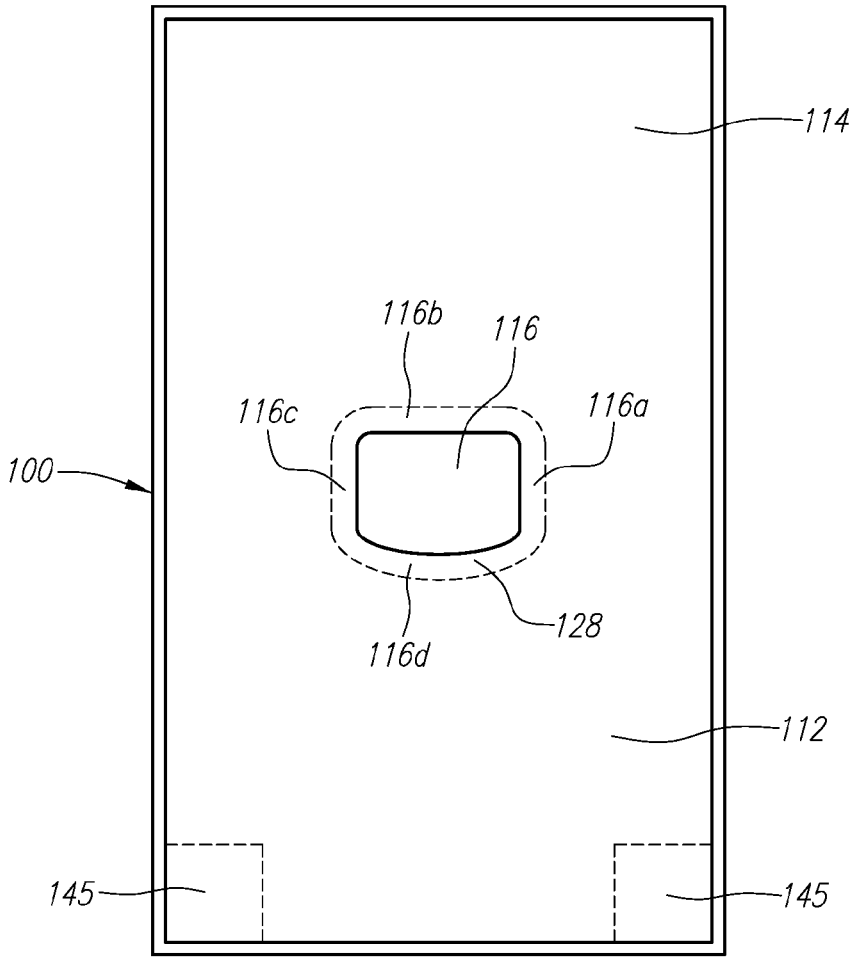
FIG. 9 is a top (exterior) plan view of the cover of FIG. 8.
Figure 10:
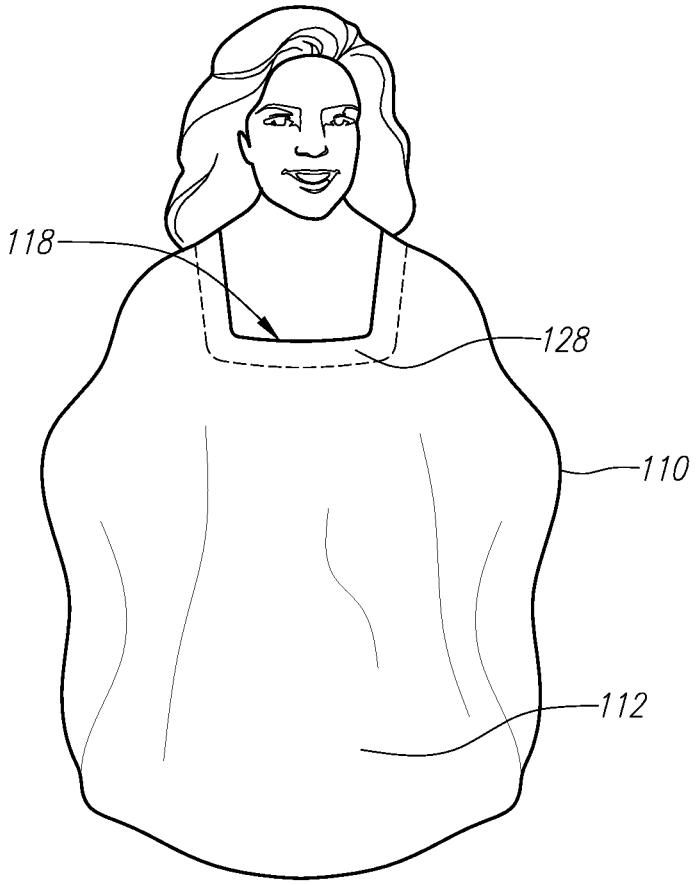
FIG. 10 shows the cover of FIG. 8 from the front as it is worn.
Figure 11:
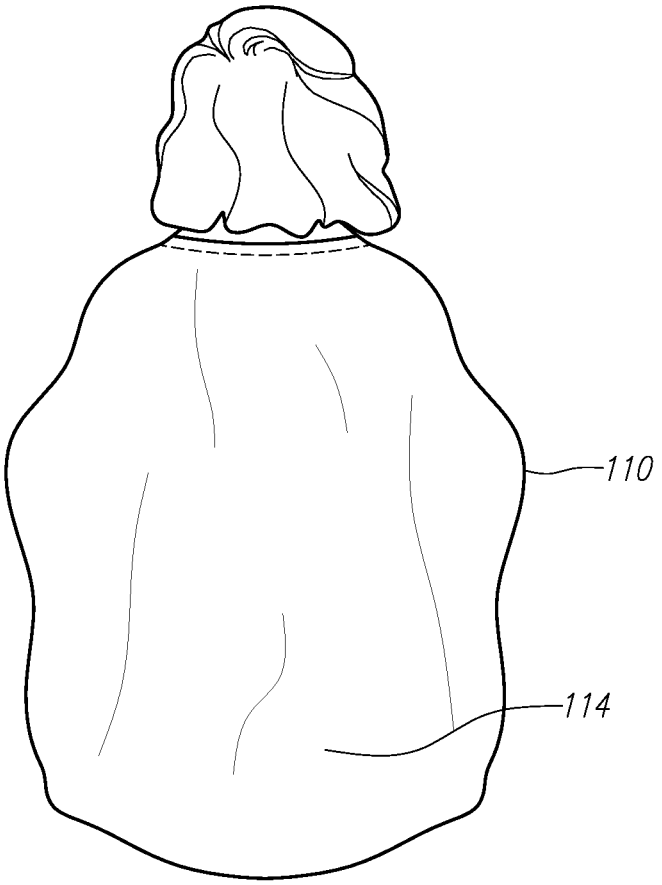
FIG. 11 shows the cover of FIG. 8 from the back as it is worn.
Figure 13A:
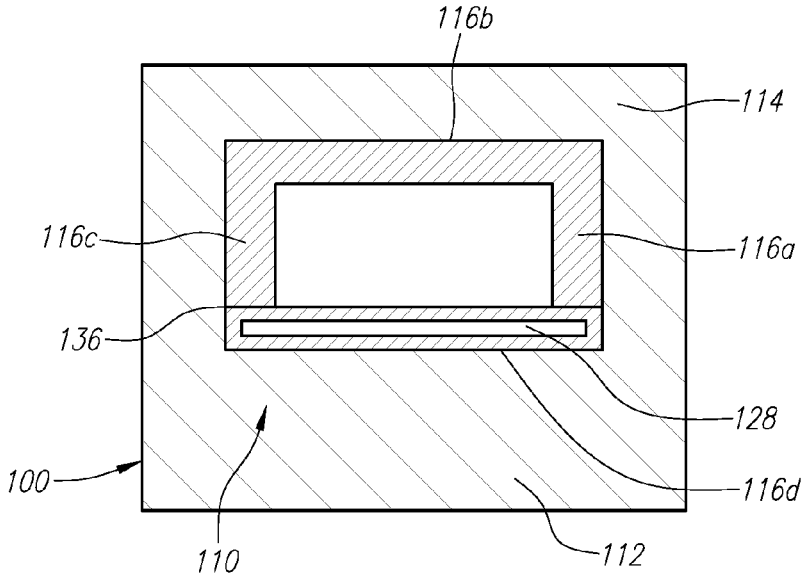
FIG. 13A is a top plan view of the cover of FIG. 8 in more detail.

Referring to FIGS. 8-11 and 13A-13C, another embodiment of cover 10 of the current invention is now described. As shown, in this embodiment, cover 10 may comprise a single contiguous sheet or piece of material 110 as opposed to separate panels that are joined. The materials discussed above may also be used for sheet 110. Here, cover 100 may include sheet 110 that may include front portion 112 and back portion 114 that cover the wearer's font and back, respectively. But as shown in FIGS. 8, 9 and 13A, there is no seam between portions 112, 114, and accordingly there are no top edges to be sewn or otherwise joined together. Instead, front portion 112 is contiguous with back portion 114. This embodiment preferably eases manufacturing and lowers costs by avoiding the sewing steps that may be associated with joining the top edges of separate panels.

In this embodiment, sheet 110 may include cutout 116 that is positioned to allow the wearer's head to go through. Cutout 116 may be square, curved or any other suitable shape and size. The facing sections 116*a*, 116*b*, 116*c*, 116*d* may comprise one or more separate pieces of material that may be sewn onto sheet 110. Alternatively, slits may be made in sheet 110 extending outward from the corners of cutout 116 so that the edges of facing sections 116*a-d* may be folded over and sewn to sheet 110 to provide durability, cushioning comfort and support. The side and bottom edges of sheet 110 may similarly be folded over and sewn as discussed earlier.

Facing sections 116*a-d* of cutout 116 may comprise neck facing as described earlier. As such, facing sections 116*a-d* of cutout 116 may provide support for the member 128. Member 128 may be similar to the examples of member 28 discussed above and may be covered by a fabric or another cover to protect against any sharp edges.

In this embodiment, member 128 may be placed on sheet 110 at the desired location, and preferably in a flat configuration. To this end, if member 128 is naturally curved, it is preferably pressed flat, and then another piece of material such as facing section 116*d* or other fabric cover may be sewn or otherwise attached to sheet 110 so as to enclose member 128.

In this embodiment, neck facing 116*a-d* may comprise one or more pieces which may be sewn to cover 100 as shown, including over member 128. Neck facing 116*d* may be sewn to cover 100 on both sides of member 128 so as to help form pocket 136. Also, the ends of neck facing 116*a*, 116*c* may also be sewn to cover 100 to close off the ends of pocket 136. Alternatively, pocket 136 may include means to remove member 128 as previously discussed.

In this configuration, neck facing 116*a-d* may provide support for the member 128 and may generate viewing area 118. For example, where neck facing 116*a*-116*d* are sewn over sheet 110, an overlap region exists that is two layers of material thick. This thickened area provides support as discussed above.

In addition, pockets 145 may be added in the right and left of the front section. The contiguous cover 100 of this embodiment may have an oval or square shape at its bottom depending on the desired style of the wearer.

Figure 13C:
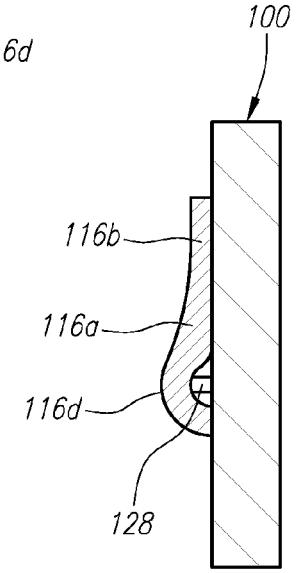
FIG. 13C is a side section view taken along section line D-D of FIG. 8.
Figure 13B:
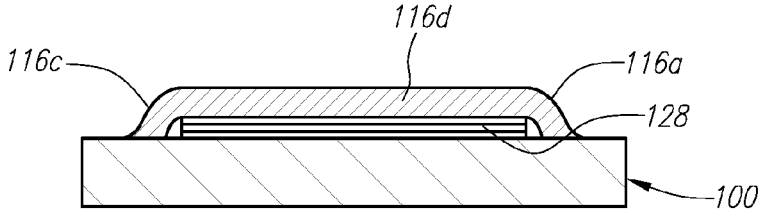
FIG. 13B is a front section view taken along section line C-C of FIG. 8.

The structure of cover 100 is now further described with reference to FIGS. 13A-13C, where different hatching lines depict different components. As shown in FIG. 13A, cover 100 preferably comprises one continuous sheet 110 with no individual panels to join along any top edges. Instead, contiguous sheet 110 may include cutout 116 with neck facing 116*a-d* sewn around at least a part of its periphery. The neck facing 116*d* may simply be sewn over member 128 as shown in FIGS. 13A-13C. The edge along facing 16*d* may be straight as shown but may assume a curved or other configuration. The sizing and dimensions of facing 16*a-d* may vary. In any event, the facing 116*a-d* preferably provides support, along with the portion of contiguous sheet 100 draped over the wearer's shoulder and, extending down the wearer's back, to member 128. For example, the increased material thickness in the facing region as well as the friction provided between sheet 100 and the wearer may provide support via a lateral constraint as discussed above.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. A privacy cover, comprising:

a front panel having a pocket;

a back panel that includes a cutout having a periphery and that is formed in the back panel for allowing a wearer's head to protrude through and that is attached to the front panel to form a first overlap region and so that the pocket is located near the cutout;

a member that is enclosed by the pocket and that has a natural curve to provide a viewing area; and a neck facing that is formed from additional material, that is installed about at least a part of the periphery of the cutout, and that is attached to the front and back panels over at least portions of the pocket and the member to form a second overlap region;

wherein the neck facing is configured to provide support for the member to provide the viewing area.

2. The privacy cover of claim 1, wherein the second overlap region is located over the first overlap region and the member.

3. The privacy cover of claim 1, wherein the neck facing extends three sides of the periphery of the cutout.

4. The privacy cover of claim 1, wherein the member comprises plastic.

5. The privacy cover of claim 4, wherein the member is adjustable by the wearer.

6. The privacy cover of claim 1, wherein the member comprises a semi-rigid or rigid material.

7. The privacy cover of claim 1, wherein the neck facing and the thickness of the first overlap region and the second overlap region support the member to provide the viewing area.

8. The privacy cover of claim 7, wherein the member is removable from the pocket.

9. The privacy cover of claim 1, wherein the first overlap region comprises three layers of material.

10. The privacy cover of claim 1, wherein the second overlap region comprises four layers of material.

11. The privacy cover of claim 1, further comprising storage pockets.

12. The privacy cover of claim 1, wherein the neck facing provides a lateral constraint on the member so that the member does not fall down on the wearer's chest.

13. The privacy cover of claim 12, wherein the lateral constraint is provided by the thickness of the first and second overlap regions.

14. A privacy cover, comprising:

a contiguous sheet of material that is extendable over a wearer's shoulders and that is extendable downward over the wearer's front and back;

a cutout in the sheet located for the wearer's head to protrude through;

a member that has a natural curve to provide a viewing area; and a neck facing that is formed from additional material, and that is installed about at least a part of the a periphery of the cutout thereby forming an overlap region;

wherein a part of the neck facing is located on the wearer's front over at least a portion of the member and is configured to form a pocket to hold the member; and wherein the neck facing is configured to provide support for the member to provide the viewing area.

15. The privacy cover of claim 14, wherein the member comprises plastic.

16. The privacy cover of claim 15, wherein the member is adjustable by the wearer.

17. The privacy cover of claim 14, wherein the member comprises a semi-rigid or rigid material.

18. The privacy cover of claim 14 wherein the neck facing extends around the entire periphery of the cutout.

19. The privacy cover of claim 14, wherein the neck facing and the thickness of the overlap region support the member to provide the viewing area.

20. The privacy cover of claim 19, wherein the member is removable from the pocket.

21. The privacy cover of claim 14, further comprising storage pockets.

22. The privacy cover of claim 14, wherein the neck facing provides a lateral constraint on the member so that the member does not fall down on the wearer's chest.

23. The privacy cover of claim 22, wherein the lateral constraint is provided by the thickness of the overlap region.

* * * * *